US005312281A

United States Patent [19]

Takahashi et al.

[11] Patent Number: 5,312,281

[45] Date of Patent: May 17, 1994

[54] ULTRASONIC WAVE NEBULIZER

[75] Inventors: Minoru Takahashi; Makoto Ono, both of Chiba; Asako Yamamichi, Kanagawa, all of Japan

[73] Assignee: TDK Corporation, Tokyo, Japan

[21] Appl. No.: 986,690

[22] Filed: Dec. 8, 1992

[30] Foreign Application Priority Data

Dec. 10, 1991 [JP] Japan ..... 3-109577[U]
Feb. 29, 1992 [JP] Japan ..... 4-019361[U]
Apr. 1, 1992 [JP] Japan ..... 4-108616

[51] Int. Cl.[5] ..... A63H 19/14; A63H 17/26; B05B 1/08

[52] U.S. Cl. ..... 446/25; 239/102.2

[58] Field of Search ..... 239/102.2, 102.1; 128/200.16; 446/24, 25

[56] References Cited

U.S. PATENT DOCUMENTS 3,160,980 12/1964 Seuthe ..... 446/25
4,044,297 8/1977 Nobue et al. ..... 239/102.2 X
4,119,096 10/1978 Drews ..... 128/200.16
4,319,155 3/1982 Nakai et al. ..... 128/200.16 X
4,702,418 10/1987 Carter et al. ..... 239/102.2 X
5,152,456 10/1992 Ross et al. ..... 239/102.2

FOREIGN PATENT DOCUMENTS 63-35824 9/1988 Japan .
63-38950 10/1988 Japan .

*Primary Examiner*—Mickey Yu
*Attorney, Agent, or Firm*—Martin Novack

[57] ABSTRACT

An ultrasonic wave nebulizer for converting water or liquid to mist has a disc-shaped piezoelectric vibrator (TD) which has a pair of surfaces one of which is defined as an operation surface. A thin plate (21) having a plurality of small holes or mesh is located close to the operation surface so that a gap or a thin water or liquid film is defined between the mesh and the operation surface. The gap spacing is smaller than the diameter of a water drop which is composed by surface tension of water where no mesh is located. Upon excitation of the vibrator with high frequency power, the water film is converted to mist. The exciting frequency is almost the same as the resonant frequency of the vibrator. The high frequency power is intermittent having duty ratio ($D_{ON}/D$) in the range from 10% to 70% so that instantaneous exciting power is high to facilitate water to mist conversion while average power is low to keep temperature at the operation surface low. The present nebulizer has many applications, including medical inhaler, a toy which generates pseudo smoke, etc. (FIG. 3)

11 Claims, 12 Drawing Sheets

ULTRASONIC WAVE NEBULIZER

BACKGROUND OF THE INVENTION

The present invention relates to an ultrasonic wave nebulizer which atomizes water or liquid with small power consumption, in particular, relates to such a nebulizer which operates with low temperature, and may adjust to the size of mist easily.

Conventionally, an ultrasonic wave nebulizer for atomizing water to adjust room humidity has been known. In that atomizer, an ultrasonic wave vibrator which vibrates in thickness direction is mounted at a bottom of a water tank. FIG. 1A shows a prior atomizer in which a tank 102 which has an ultrasonic wave vibrator 103 at the bottom of the same contains water 101. When the piezoelectric vibrator 103 vibrates a water column 104 is generated on surface of water 101, and the water column 104 generates fine mist.

FIG. 1B shows the relationship between water depth (H) and amount of generated mist (vertical axis). When the vibration frequency is 1.7 MHz, and the diameter of the vibrator is 20 mm, the maximum generation of mist is obtained when the water depth is from H=30 mm to H=40 mm.

However, the prior atomizer has the disadvantage that the size of the device is rather large, since the vibrator must be mounted at the bottom of the water tank with the depth of 30–40 mm.

Further, the prior atomizer has the disadvantage that the power consumption is rather large as shown in FIG. 1C in which the horizontal axis shows the power consumption, and the vertical axis shows the amount of the mist. The minimum power consumption $W_0$ in a prior art is around 6 watts. As an atomizer for converting 400 cc/hour $cm^3$/hour) of water to mist consumes about 40 watts, that power consumption is too high for a battery operating atomizer or a portable atomizer.

Another prior atomizer is shown in JP UM second publication 38950/88, which has a cone shaped horn having a resonator plate on one end having a small diameter, and a piezoelectric vibrator on the other end having a large diameter. Water is supplied on the resonator plate. The spacing between the resonator plate and the vibrator is designed to be half wavelength. As the vibration of the vibrator is amplified according to the ratio of the area of the plate to the area of the vibrator, the amplitude of the plate is very large, and water drop on the plate is atomized.

However, the atomizer shown in JP UM 38950/88 has the disadvantages that (1) the essential operation area of the plate for atomizing is small, (2) as the vibration is mechanically amplified, the horn must be manufactured very precisely, and a problem could occur due to the difference of the thermal expansion between the vibrator and the horn, and (3) the size of mist is rather large for instance 20 μm), as the operation frequency must be rather low (100–150 KHz for instance) because of the mechanical amplification.

In order to solve the above disadvantages, we have proposed an improved nebulizer in U.S. Ser. No. 07/889067, and EP 420177.5, which shows a nebulizer having a disc-shaped piezoelectric vibrator, and a mesh located close to the vibrator so that thin water film is provided between the mesh and the vibrator. Upon excitation of the vibrator with high frequency, which is almost the same as the resonant frequency of the vibrator, the water film is converted to mist.

The present invention is an improvement on said previously filed nebulizer. The improvements reside in that the operation temperature of a vibrator is decreased, and that the size of generated mist is easily adjustable.

When the temperature is high, the nebulizer cannot be used for atomizing liquid which dissolves at high temperature. Further, the size of mist in the prior art is not easily adjusted, although the size of mist depends upon the exciting frequency of a piezoelectric vibrator, since the exciting frequency must coincide with the resonant frequency of a piezoelectric vibrator.

SUMMARY OF THE INVENTION

It is an object of the present invention to overcome the disadvantages and limitations of a prior nebulizer by providing a new and improved nebulizer.

It is also an object of the present invention to provide a nebulizer which atomizes water or liquid by using a piezoelectric vibrator which operates in low temperature which does not dissolve or destroy liquid to be atomized.

It is also an object of the present invention to provide a nebulizer which can adjust the size of mist easily.

Another object of the present invention is to provide an application of the present nebulizer to generate pseudo smoke.

The above and other objects are attained by an ultrasonic wave nebulizer comprising; a piezoelectric vibrator having a pair of electrodes on respective each surfaces of the vibrator and defining an operation surface to one of the surfaces; a holder for holding said vibrator; a thin plate member having a plurality of small holes or a mesh having at least a portion located close to said operation surface so that an essential gap space is provided between said portion of the plate member and the operation surface of the vibrator and thin liquid film is provided in said gap space through capillary action; supply means for supplying liquid to said gap space; a high frequency generator for exciting said vibrator; connecting means for connecting said generator to said electrodes of the vibrator; said vibrator vibrating in thickness direction of the vibrator upon being excited with high frequency power between said electrodes to convert said thin liquid film to mist; said high frequency generator exciting said vibrator intermittently with a predetermined duty ratio.

BRIEF DESCRIPTION OF THE DRAWINGS

The foregoing and other objects, features and attendant advantages of the present invention will be appreciated as the same become better understood by means of the following description and accompanying drawings wherein.

DESCRIPTION OF THE PREFERRED EMBODIMENTS

Figure 1A:
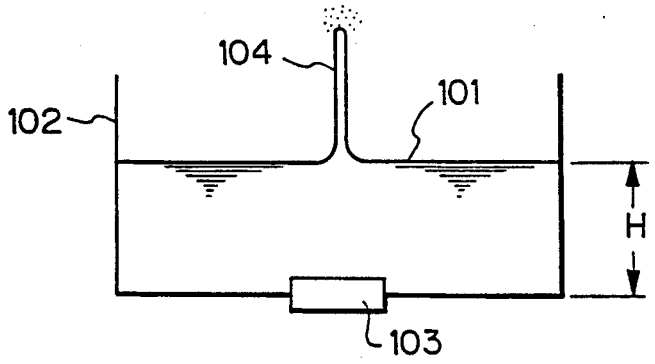
Fig. 1A PRIOR ART
FIG. 1A–1C shows the explanatory figure of a prior ultrasonic wave nebulizer.
Figure 1B:
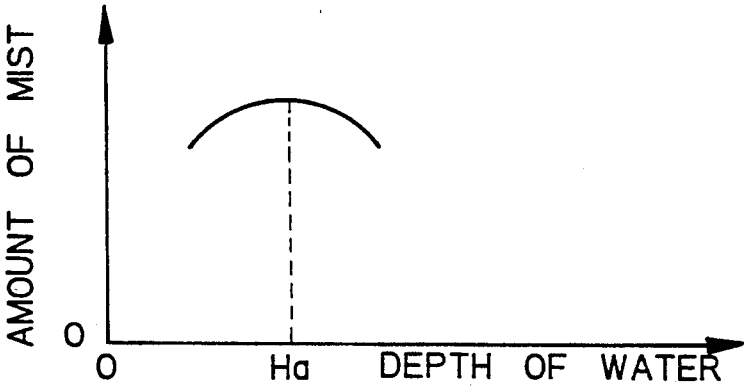
Fig. 1B PRIOR ART
Figure 1C:
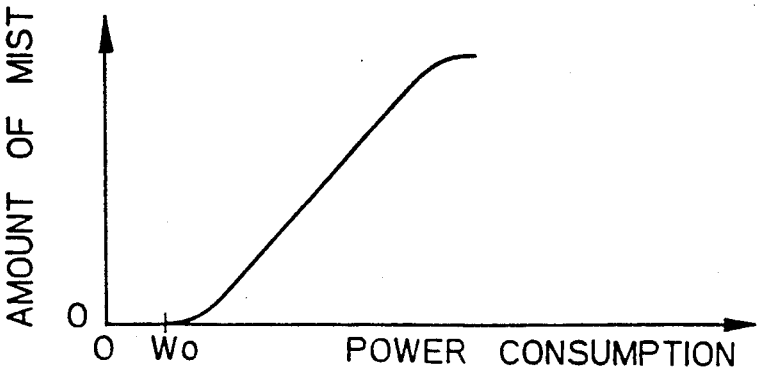
Fig. 1C PRIOR ART
Figure 2:
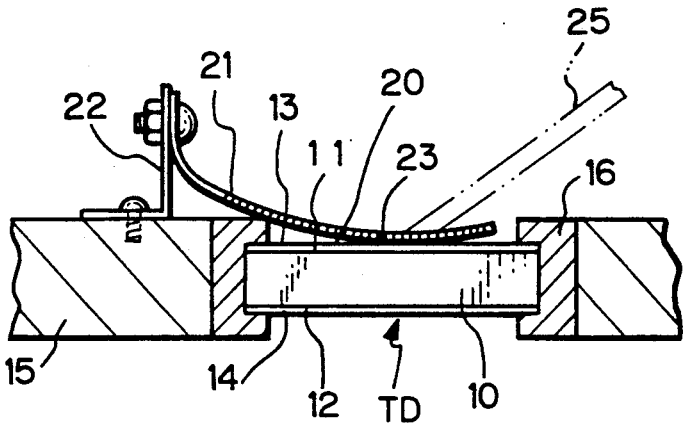
FIG. 2 shows structure of a vibration unit according to the present invention.
Figure 3:
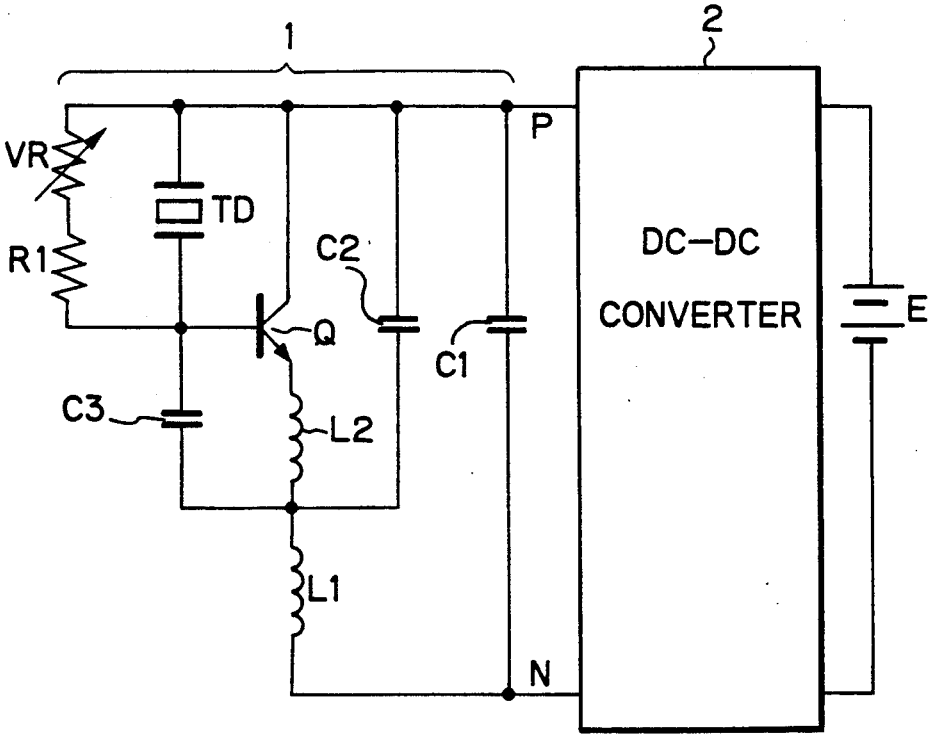
FIG. 3 shows a circuit diagram of an exciting circuit for exciting a vibrator according to the present invention.

FIG. 2 shows an example of a vibration unit of the nebulizer according to the present invention, and FIG. 3 shows a circuit diagram of an excitation circuit for exciting a piezoelectric vibrator.

FIG. 2 shows an example of structure of a vibrator unit according to the present invention, in which the vibration of the piezoelectric vibrator TD in thickness direction is used for atomization. The vibrator TD is in disc-shaped, and has a disc-shaped piezoelectric element 10 having a first operation surface 11 and a second rear surface 12. Those surfaces 11 and 12 are provided with electrodes 13 and 14, respectively. The numeral 15 is a holder for holding the vibrator. The numeral 16 is a resilient ring-shaped support having an annular groove for accepting the piezoelectric element 10. The support 16 is fixed to the holder 15. A piezoelectric vibrator is obtained by polarizing ceramics disc.

Figure 5A:
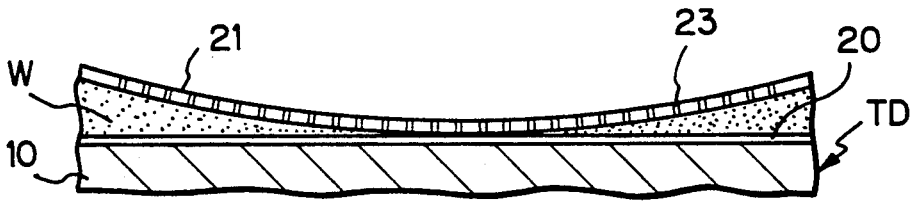
FIG. 5A–5C shows explanatory drawings for the operation of a nebulizer according to the present invention.

A thin plate member 21 having a plurality of small holes is located above the operation surface 11 of the vibrator TD. Said thin plate member is implemented for instance by a mesh. One end of the mesh 21 is fixed to the holder 15 through the L-shaped fixed 22. The mesh 21 has a curved convex portion which has holes, and the convex portion touches or faces with the vibrator TD with small spacing, as shown in FIG. 5A, so that a spacing less than 100 μm is provided between the mesh and the vibrator.

The thickness of the mesh 21 is in the range from 50 μm to 200 μm, made of stainless steel. The diameter of a hole on the mesh 21 is in the range from 5 μm to 100 μm. If the thickness of the mesh 21 is larger than 200 μm, it would be not easy to provide many holes, and the efficiency for atomization would be lowered. If the diameter of a hole 23 is larger than 100 μm, the efficiency for atomization would be lowered, and the size of mist wouldn't be uniform.

The numeral 25 in FIG. 2 is a liquid supply tube for supplying water or liquid between the mesh and the vibrator. That tube 25 may be a capillary tube, and in that case a water tank (not shown) is located at the level lower than the vibrator TD.

The mesh 21 is preferably conductive. The high frequency exciting power is applied across the electrodes 13 and 14, through the mesh 21, and the L-shaped member 22. A pair of lead wires (not shown) are connected to the L-shaped member 22 and the rear electrode 14.

In FIG. 3, the numeral 1 shows an oscillation circuit which oscillates intermittently with a predetermined duty ratio for exciting a vibrator TD, 2 is a DC-DC converter which converts input low DC voltage (for instance in the range from 3 V to 6 V) of a battery E to operational high DC voltage (for instance 30 V) having a positive output terminal P and a negative output terminal N. The DC-DC converter can be a conventional one.

An oscillator 1 is a transistor oscillation circuit with a collector grounded. The circuit is essentially a so-called Colpitts oscillation circuit. The circuit has a transistor Q, a resistor R1 and a variable resistor VR for supplying base current for the transistor Q, inductors L1 and L2 coupled between the N terminal of the DC-DC converter 2 and an emitter of the transistor Q, a capacitor C1 coupled across the terminals P and N, a capacitor C2 connected between a junction of the inductors L1 and L2, and a collector of the transistor Q, a capacitor C3 connected between a base of the transistor Q and the junction of the inductors L1 and L2. The vibrator TD is coupled between the collector of the transistor Q and the base of the transistor Q.

The oscillation circuit 1 is a self-oscillation circuit which oscillates with the frequency which is close to the resonant frequency of the vibrator TD, and has the vibrator TD inductive. When the resistance of the series circuit of the resistor R1 and the variable resistor VR is considerably larger than the resistance which provides continuous oscillation, the continuous oscillation stops in a short time, so that the intermittent oscillation is obtained. The resistance of the series circuit (R1 and VR) and the capacitor C3 provide a time constant circuit. When the oscillation continues a predetermined duration, the voltage across the capacitor C3 decreases so that the base current of the transistor is decreased lower than a threshold value for continuing oscillation. Therefore, the oscillation stops. Then, the voltage across the capacitor C3 increases, and the circuit oscillates again for a predetermined duration. That operation repeats, and therefore, the circuit has an oscillation period and a non-oscillation period alternately. Thus, the intermittent oscillation is obtained.

As the impedance of the piezoelectric vibrator TD which is coupled parallel to the base bias resistors (R1 and VR) decreases when the vibrator TD is loaded by water which is subject to mist, the oscillation frequency of a self oscillation circuit is higher when the vibrator is loaded than the frequency when the vibrator is not loaded. And, the input power to the vibrator TD when the vibrator is loaded is lower than the input power when the vibrator is not loaded. When an oscillation circuit is a separately-excited circuit, the frequency does not depend upon the load.

The preferable numerical values of the circuit elements are as follows when the resonant frequency of the vibrator TD is 1.67 MHz.

Capacitor C1; $18\times10^4$ pF

Capacitor C2; $24\times10^2$ pF

Capacitor C3; $47\times10^3$ pF

Inductor L1; 22 μH

Inductor L2; an air-core coil of 2.5 turns with diameter 6.5 mm

Variable resistor VR; maximum 100 KΩ
Resistor R1; 100 KΩ

Figure 4:
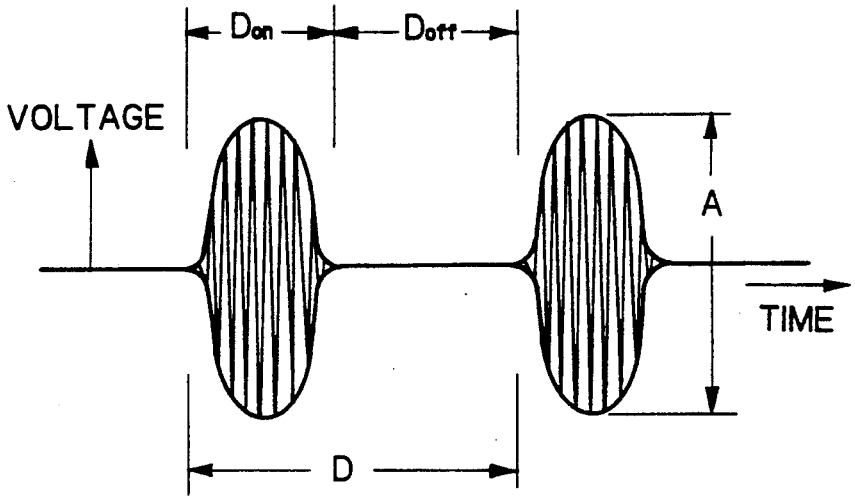
FIG. 4 shows an example of wave-form for exciting a vibration according to the present invention.

FIG. 4 shows wave-form of intermittent oscillation of a vibrator TD. The symbol D shows an intermittent period, $D_{ON}$ shows the oscillation period. The duty ratio of oscillation is defined by the ratio of D and $D_{ON}$ so that the duty ratio is $D_{ON}/D$. The input power to the vibrator TD is proportional to;

$$(D_{ON}/D)\times A^2$$

where A is amplitude of oscillation. Therefore, when the duty ratio ($D_{ON}/D$), and the input power P are designed properly, the input power P may be small, and the amplitude A for atomization may be large.

The amplitude A of exciting power must be higher than a predetermined threshold value which effects atomization, and the average power applied to a vibrator may be kept low by properly designing duty ratio.

In the above configuration, the duty ratio ($D_{ON}/D$) of the exciting power is controlled less than 70% by adjusting the variable resistor VR in FIG. 3. The DC potential across the output terminals P and N of the DC-DC converter 2 must be high enough for providing the amplitude A of the oscillation power for atomization. If the amplitude A is smaller than a threshold value, no atomization occurs on the surface of the vibrator, and no mist is obtained.

With the above intermittent power supply to the vibrator, water or liquid film between the surface of the vibrator and the mesh is atomized, and released into air through holes of the mesh.

FIG. 5 shows the operation of the present nebulizer. When the oscillation stops ($D_{OFF}$), the curved convex end of the mesh 21 touches with the vibrator surface through spring action of the mesh and/or gravity action as shown in FIG. 5A.

Figure 5B:
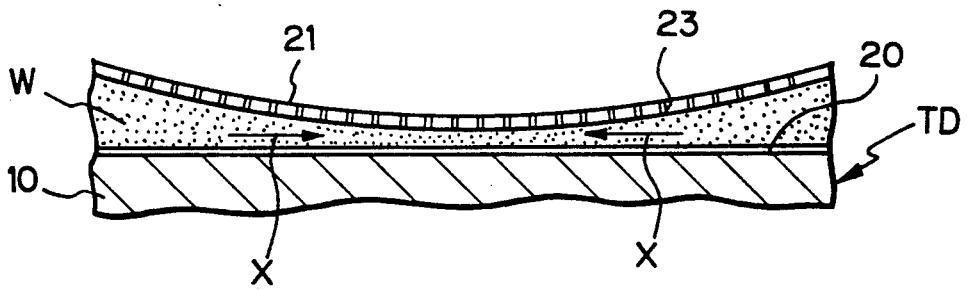

When the oscillation is active ($D_{ON}$), a fine spacing is provided between the curved end of the mesh 21 and the vibrator surface by the vibration action, and water or liquid comes into that fine spacing and is atomized, as shown by the arrow X in FIG. 5B.

Figure 5C:
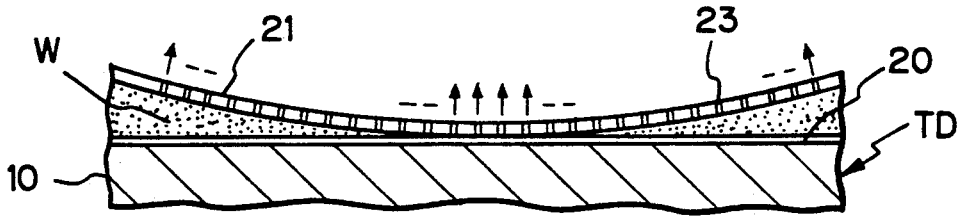

Next, when the oscillation stops again ($D_{OFF}$), the curved end of the mesh 21 touches with the vibrator as shown in FIG. 5C, and at that time, water or liquid film in the fine spacing between the curved end of the mesh and the vibrator is atomized, and the mist thus produced is released into air through the holes of the mesh 21.

The size or diameter of mist depends upon exciting frequency, diameter of a hole of the mesh, and duty ratio of exciting power.

Figure 6:
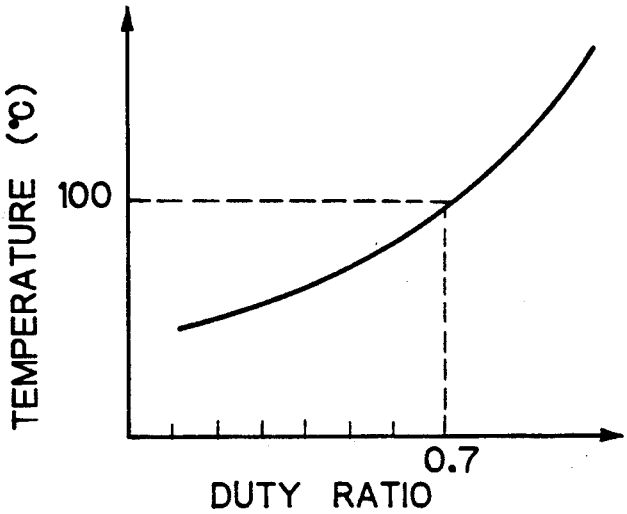
FIG. 6 shows relations between duty ratio of power supply to a vibrator and surface temperature of a vibrator.

FIG. 6 shows the relationship between the duty ratio of exciting power and the temperature of the vibrator TD. It should be noted that when the duty ratio is less than 70%, the temperature is less than 100° C., however, when the duty ratio is higher than 70%, the temperature is higher than 100° C. If the temperature is higher than 100° C., the vibrator would break, and further, liquid to be nebulized would be dissolved or destroyed. Therefore, it is preferable that the duty ratio is less than 70%. It should be appreciated that the amplitude of exciting power can not be lowered in order to lower the temperature of a vibrator, since no atomization occurs if the amplitude of exciting power is less than a predetermined value.

Figure 7:
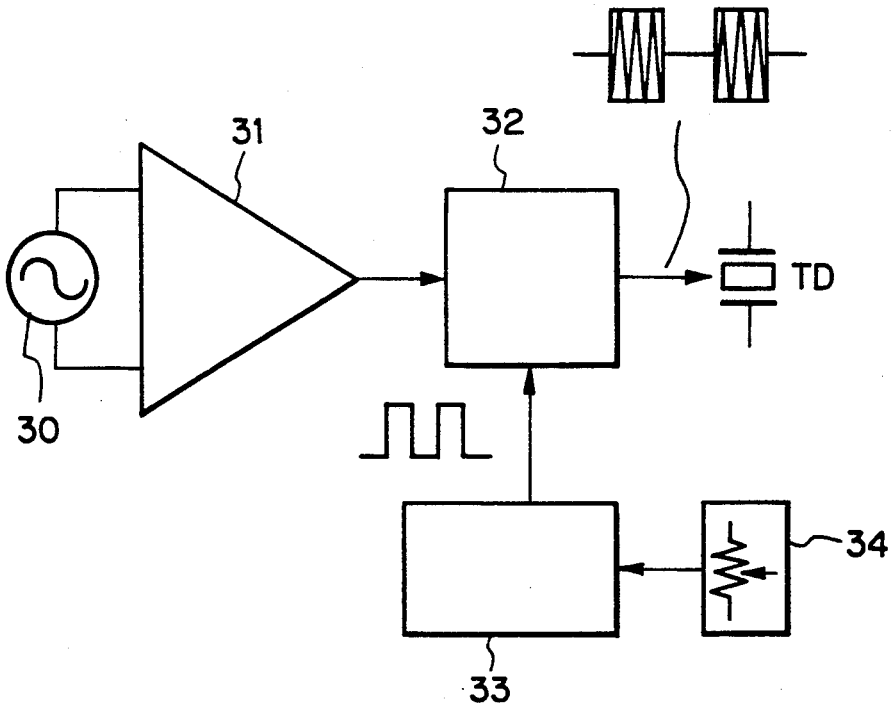
FIG. 7 is a block diagram of another embodiment of an exciting circuit according to the present invention.

FIG. 7 shows another embodiment of the exciting circuit according to the present invention. FIG. 7 shows the embodiment of separately-excited circuit. In the figure, the numeral 30 is an oscillator, 31 is an amplifier, 32 is a modulator (for instance a ring-modulator) or a switching circuit, 33 is a gate pulse generator, and 34 is a duty ratio adjust circuit. The oscillator 30 generates the frequency which is close to the resonant frequency in the thickness vibration of the vibrator TD. The gate pulse generator 33 generates a gate pulse for exciting the modulator 32 so that the duty ratio of the output of the modulator 32 is less than 70%. The duty ratio adjust circuit 34 adjusts the duty ratio $D_{ON}/D$ of the gate pulse so that the pulse period of the gate pulse generator 33 is D and the pulse width of the same is $D_{ON}$.

The oscillation output of the oscillator 30 is applied to the modulator 32 through the amplifier 31. The modulator 32 modulates the oscillation output according to the gate pulse which is supplied by the gate pulse generator 33. Thus, the intermittent exciting power having the duty ratio $D_{ON}/D$ is applied to the vibrator TD, which generates mist.

Figure 8:
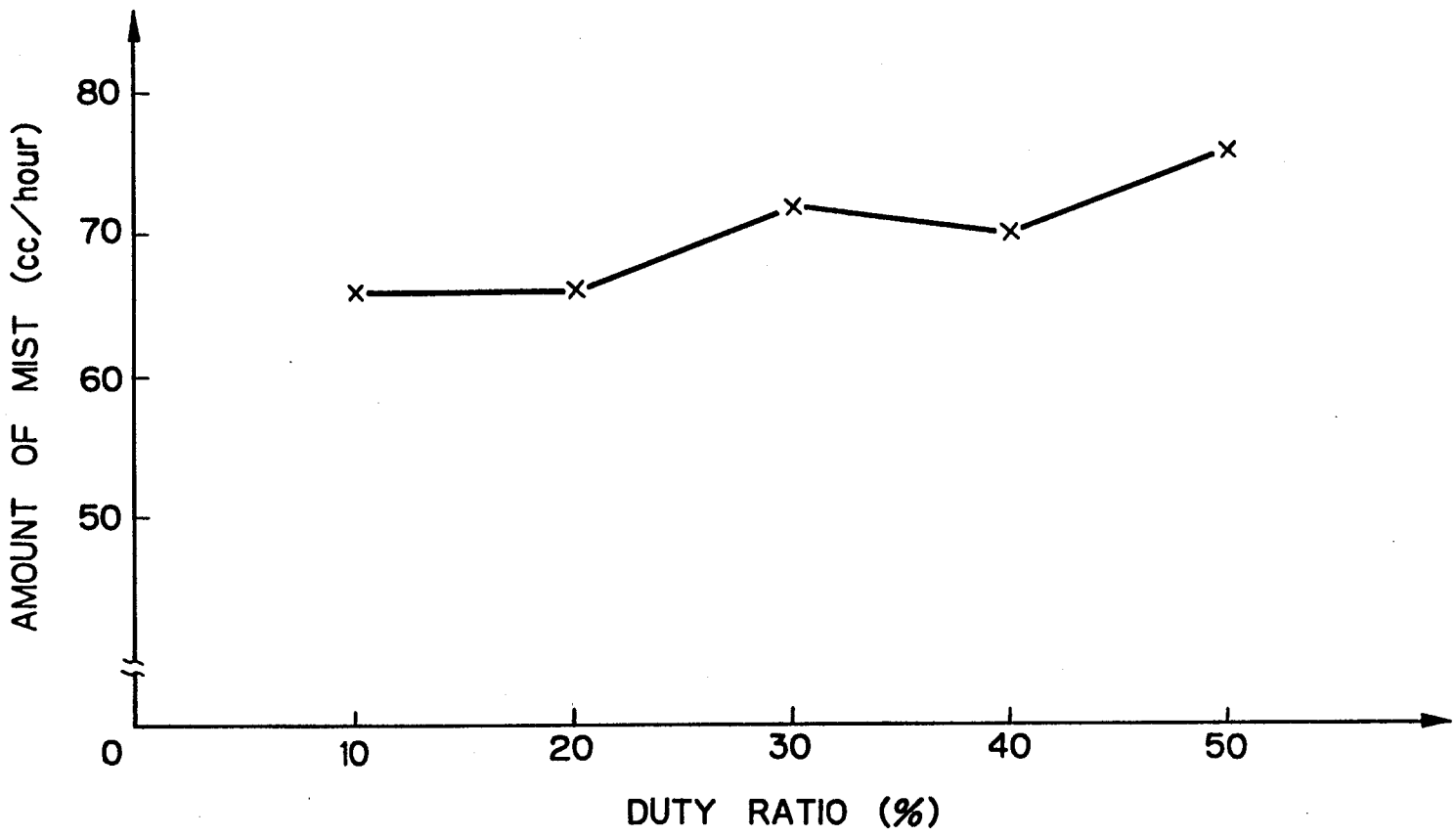
FIG. 8 shows the relations between duty ratio of exciting power and amount of generated mist.

FIG. 8 shows the experimental relationship between the duty ratio (horizontal axis in %), and the amount of mist (vertical axis in $cm^3$/hour) in the separately excited circuit of FIG. 7, where the diameter of a vibrator is 20 mm, the thickness of a mesh is 0.043 mm, the oscillation frequency is 1.630 MHz, the intermittent frequency is 5 KHz, the voltage across the vibrator is 40 V (peak-to-peak). It should be noted in FIG. 8 that the amount of mist does not change much when the duty ratio is in the range from 10% to 70%, therefore, it is preferable that the duty ratio is in that range (from 10% to 70%).

The curve of FIG. 8 is obtained by using a separately excited circuit of FIG. 7, but it should be appreciated of course that a self oscillation circuit of FIG. 3 would also provide the similar curve.

Figure 9:
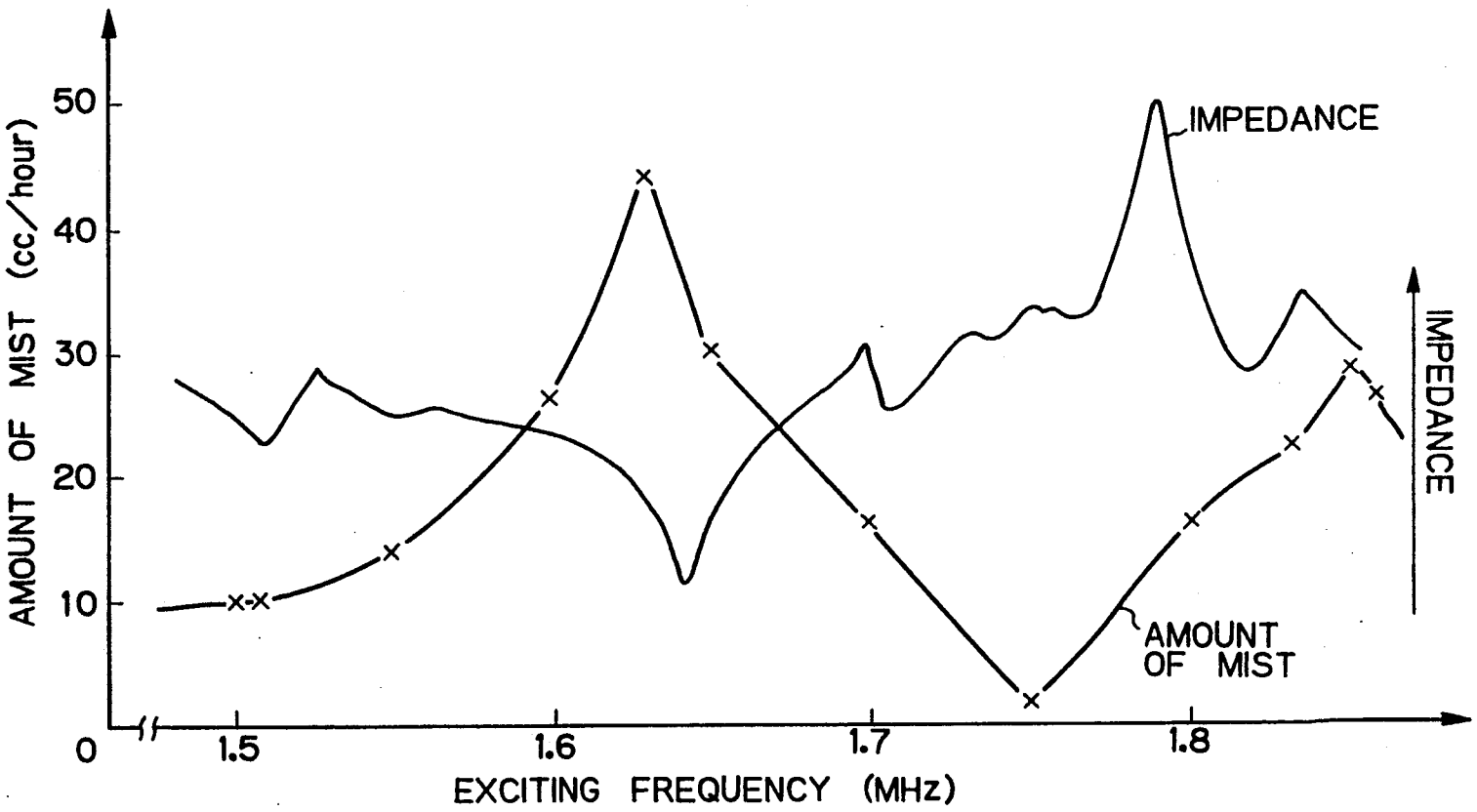
FIG. 9 shows curves between exciting frequency, and impedance of a vibrator and amount of generated mist.

FIG. 9 shows curve between the oscillation frequency (horizontal axis) and the impedance of a vibrator (vertical axis), and the curve between the oscillation frequency (horizontal axis) and the amount of mist (vertical axis), when the separately excited circuit of FIG. 7 is used, where the diameter of a vibrator is 20 mm, the thickness of a mesh is 0.043 mm, the intermittent frequency is 5 KHz (=1/D), the duty ratio is 20%. It should be noted in FIG. 9 that the amount of mist generated is the maximum when the oscillation frequency is close to the resonant frequency.

Figure 10A:
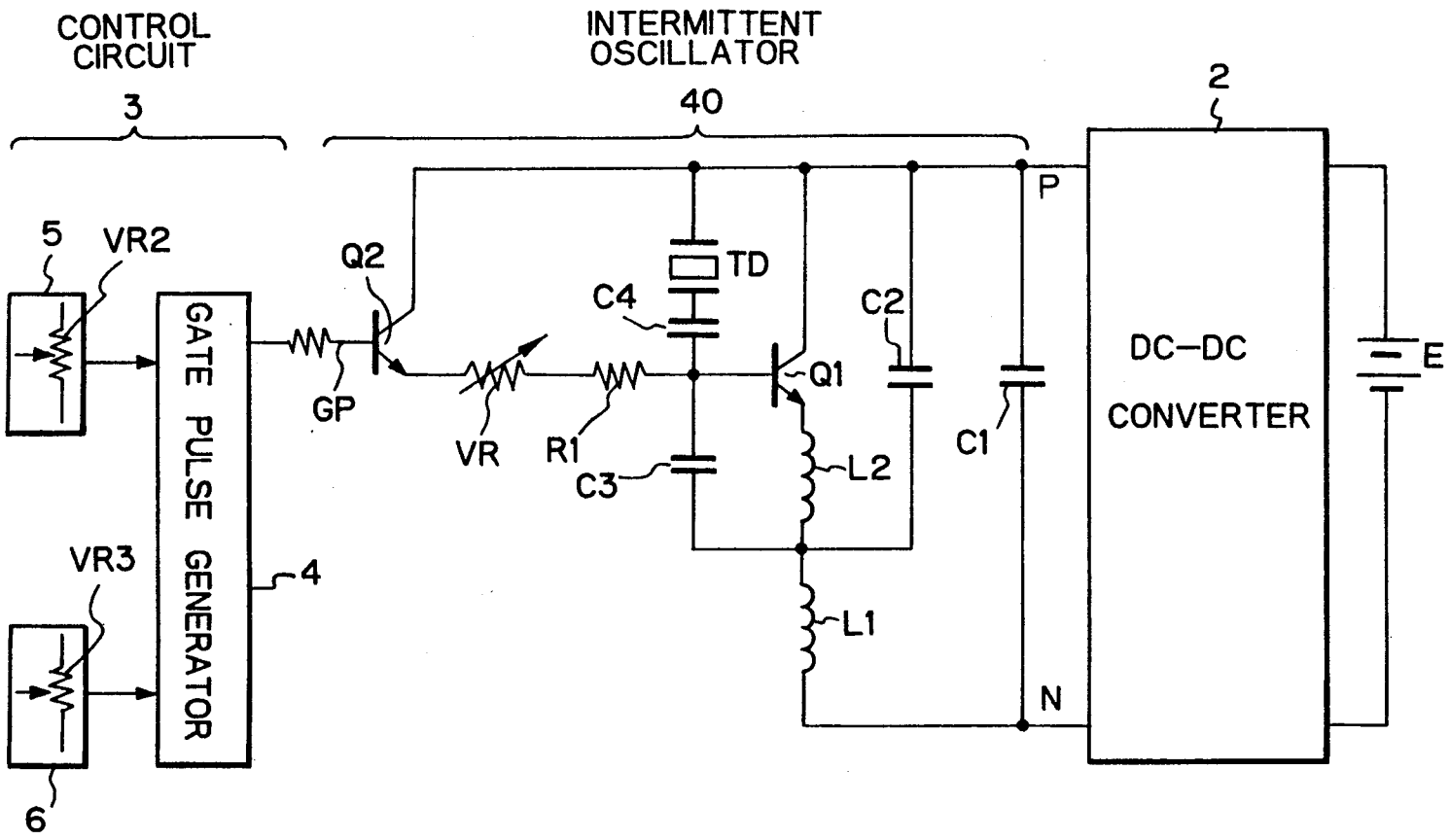
FIG. 10A is a block diagram of still another exciting circuit according to the present invention.

FIG. 10A shows a circuit diagram of still another embodiment of an exciting circuit according to the present invention. In the figure, the numeral 40 shows an intermittent oscillation circuit which excites a vibrator TD intermittently, 2 is a DC-DC converter which boosts the voltage of a battery E, and supplies the operational power to the exciting circuit across the terminals P and N. The numeral 3 is a control circuit for adjusting the intermittent frequency, and the duty ratio.

The intermittent oscillation circuit 40 is a transistor oscillation circuit with a collector grounded. It comprises a transistor Q1. A bias circuit for flowing base bias current to the transistor Q1 has a resistor R1, a variable resistor VR, and a switching transistor Q2. Inductors L1 and L2 are coupled between the terminal N of the DC-DC converter 2 and the emitter of the transistor Q1. The capacitor C1 is coupled across the terminals P and N of the DC-DC converter 2. The capacitor C2 is coupled between the junction of the inductors L1 and L2, and the collector of the transistor Q1. The capacitor C3 is coupled between the junction of the inductors L1 and L2, and the base of the transistor Q1. The piezoelectric vibrator TD is coupled between the base and the collector of the transistor Q1 through the capacitor C4.

The control circuit 3 has a gate pulse generator 4 for supplying a rectangular gate pulse GP to the base of the switching transistor Q2, intermittent frequency (repetition frequency of exciting power) and duty ratio of a gate pulse GP are adjusted by adjusting circuits 5 and 6. The control circuit 3 may supply the gate pulse of the frequency in the range from several Hz to around 60 KHz with the duty ratio in the range from several % to around 70% by adjusting the adjust circuits 5 and 6.

In the intermittent oscillation circuit 40, when the switching transistor Q2 is conductive by accepting a gate pulse GP from the control circuit 3, the base bias current in the transistor Q1 flows from the terminal P, through the collector-emitter circuit of the switching transistor Q2, the variable resistor VR, and the resistor R, to the base of the transistor Q1, so that the transistor Q1 oscillates with the frequency which is close to the resonant frequency of the vibrator TD and makes the vibrator TD inductive. The oscillation frequency thus determined is for instance 1.6 MHz, or 2.4 MHz.

Figure 10B:
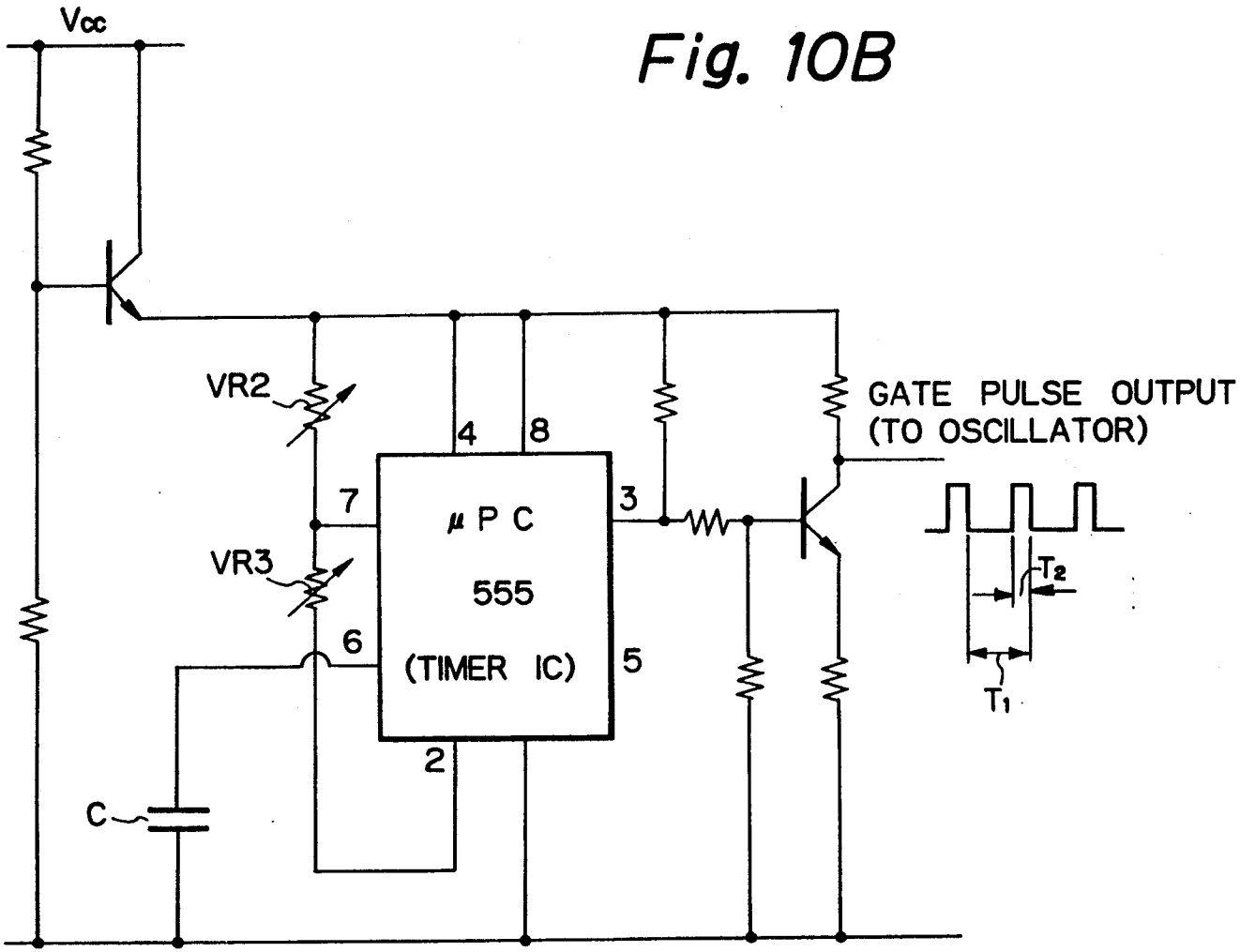
FIG. 10B is a block diagram of a gate pulse generator in FIG. 10A.

FIG. 10B shows a block diagram of the control circuit 3, which has a timer IC (integrated circuit) commercially available in the name μPC-555 manufactured by Texas Instruments Co, and two variable resistors VR2 and VR3, and the capacitor C. The frequency F of the gate pulse is determined;

$$F=1.443/C(VR2+2VR3)$$

and the duty ratio d of the gate pulse is;

$$d=T_2/T_1=VR3/(VR2+VR3)$$

where VR2 and VR3 in those equations show the resistance of the respective variable resistors. Thus, the frequency and the duty ratio of the gate pulse are adjusted by adjusting the two variable resistors.

In FIG. 10A, when the variable resistor VR is adjusted so that the circuit oscillates, and the control circuit 3 supplies the gate pulse having the desired frequency and the desired duty ratio, the intermittent oscillator 40 oscillates intermittently. Then, the vibrator TD vibrates in the thickness direction. Thus, the water film or the liquid film on the vibrator TD is nebulized, and the nebulized mist is released into air through holes of the mesh.

In our experiment, the diameter of the mist released into air and the intermittent frequency (1/D) have the following relationship as shown in the table 1.

TABLE 1

| Intermittent frequency | Average diameter |
|---|---|
| 10 Hz | 5 μm |
| 100 Hz | 6 μm |
| 500 Hz | 7 μm |
| 1 KHz | 23 μm |
| 10 KHz | 25 μm |
| 20 KHz | 25 μm |

Therefore, it should be noted that it is possible to adjust the diameter of mist by adjusting the intermittent frequency, although the theoretical analysis is not given.

The preferable intermittent frequency of exciting power is in the range from 10 Hz to 20 KHz in the above table to adjust size of mist, and still preferably, the intermittent frequency is in the range from 10 Hz to 10 KHz.

When we consider to use the present nebulizer in a medical field, for instance a medical inhaler, the diameter of mist (mist of liquid medicine) must be controlled depending upon which part of a body absorbs mist. As the present nebulizer may adjust diameter or size of mist merely by adjusting intermittent frequency, it is useful to apply the present nebulizer in medical field.

Figure 11:
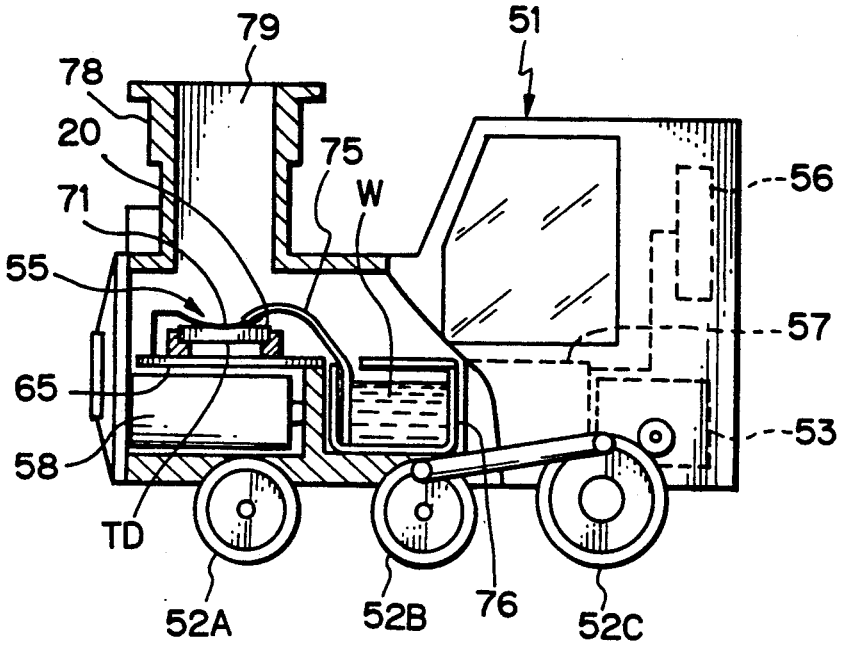
FIG. 11 shows structure of a toy which is an application of the present invention.
Figure 12:
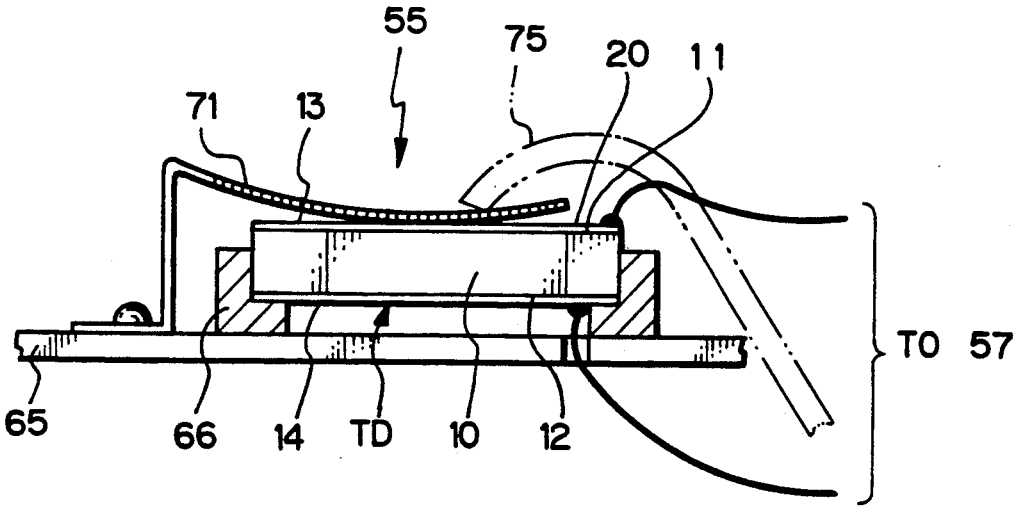
FIG. 12 shows structure of a nebulizer which is used in a toy in FIG. 11.
Figure 13:
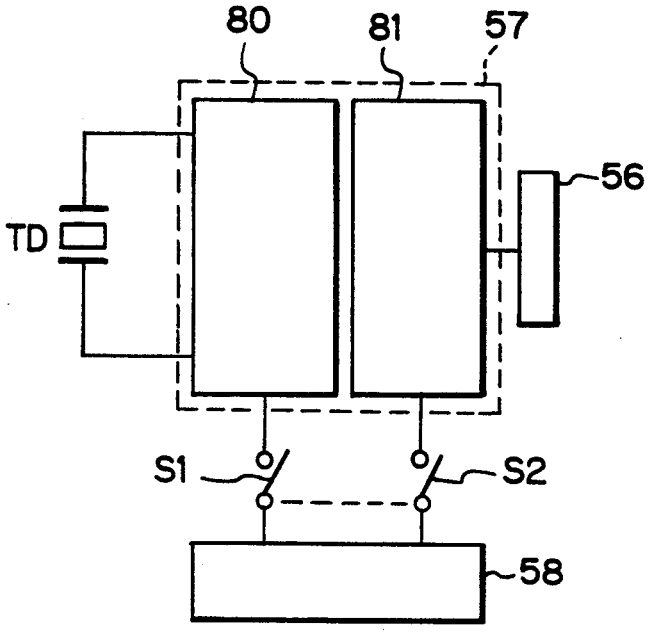
FIG. 13 is a brief block diagram of an exciting circuit for exciting a nebulizer for a toy in FIG. 11.

FIGS. 11 through 13 show one application of the present nebulizer used in a smoke generator in a toy of a steam locomotive. In those figures, the numeral 51 is a casing of a toy, having a plurality of rotatable driving wheels 51A, 51B, 51C at the lower portion of the casing. One of the driving wheels 51C is engaged with a DC motor 53 which is secured in the casing 51. The casing 51 includes a vibrator 55 of a nebulizer, a whistle buzzer 56 which is implemented by an electromagnetic buzzer or a piezoelectric buzzer, an oscillation circuit 57 for operating the vibrator unit 55, and a battery 58 for operating the motor, the buzzer and the nebulizer.

FIG. 12 shows the vibrator unit 55, which has support 65 fixed to the casing 51. The vibrator TD is kept horizontally on the support 65 through the resilient member 66, and the mesh 71 is fixed to the support 65 so that the mesh 71 is curved and the convexed surface of the mesh touches or faces with the vibrator with thin spacing. A part of the mesh 71 may touch with the vibrator TD. Preferably, the vibrator TD is fixed just under an opening 79 of a chimney 78. The vibrator TD has a pair of electrodes 13 and 14 on both the major surfaces 11 and 12, respectively, of the piezoelectric disc 10. The vibrator TD vibrates in thickness direction of the disc upon exciting the same with high frequency power applied across the electrodes 13 and 14.

A capillary tube 75 which is implemented by a bundle of fibers is provided with one end touched with the mesh, and the other end dipped into water W in a tank 76. Water is supplied to the mesh from the tank 76 through the capillary tube 75 by the capillary action, and is nebulized by the vibration of the vibrator TD. The nebulized mist is released into air through the chimney. The released mist looks like smoke in a steam locomotive.

FIG. 13 is a brief block diagram of the exciting circuit 57 in FIG. 11. It has an exciting circuit 80 for providing exciting power to the vibrator, and a buzzer circuit 81 for energizing a buzzer 56 as a whistle. Those circuits are coupled with a battery 58 through a gang switch S1 and S2 which is pushed ON or OFF at outside of the casing 51. The exciting circuit 80 has a DC-DC converter, and an intermittent oscillation circuit for providing exciting high frequency power to a vibrator unit 55.

Water W in the water tank 76 is applied to the surface 20 of a vibrator TD through the capillary tube 75. The water extends in a fine spacing between the vibrator surface and the mesh 71. Upon switching ON the switches S1 and S2, the exciting circuit 80 and the buzzer circuit 81 are connected to the battery 58 simultaneously, and therefore, the buzzer 56 whistles, and the chimney 78 provides pseudo smoke through the opening 79 by releasing water mist which is generated by the vibrator TD.

In one modification, the switches S1 and S2 are operated separately, instead of the gang operation. In that case, whistle sound and smoke are provided separately.

It should be appreciated that the present invention provides pseudo smoke, which is generated in low temperature, with no smell, and no environment problem.

Figure 14:
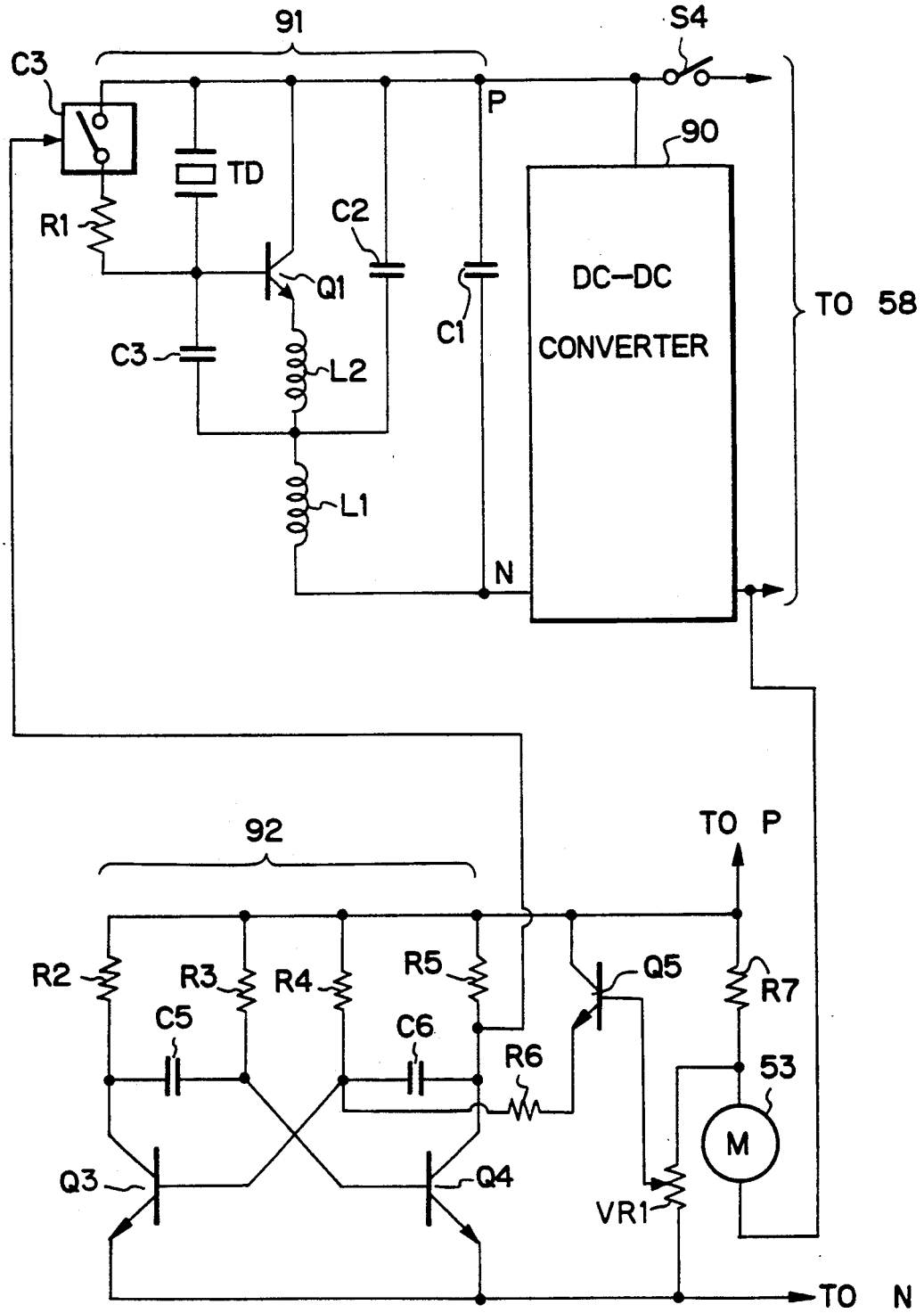
FIG. 14 shows a circuit diagram of an exciting circuit used in a toy of FIG. 11.

FIG. 14 shows the modification of the vibrator excitation circuit for energizing a vibrator in a toy of a steam locomotive. The feature of that circuit is to synchronize smoke with rotation of driving wheels 52A, 52B and 52C. In FIG. 14, the numeral 90 is a DC-DC converter for boosting battery voltage to operational voltage of the circuit, 91 is an oscillator for exciting the piezoelectric vibrator TD, 92 is an astable multi-vibrator circuit for exciting said oscillator 92 intermittently.

The oscillator 91 has a transistor Q1, inductors L1 and L2, capacitors C1, C2 and C3, a bias resistor R1 in a base circuit of the transistor Q1, and an electronic switch S3 inserted in series with the bias resistor R1. The astable multi-vibrator 92 has transistors Q3 and Q4 which conduct alternately, capacitors C5 and C6, and the resistors R2, R3, R4 and R5 et al. The series circuit of the transistor Q5 and the resistor R6 is coupled with the resistor R4 in parallel. The DC motor 53 which rotates the driving wheel 52C is coupled with the battery 58 through the resistor R7 and the switch S4 which is operable externally. At the initial stage of the motor 53, the rotation speed of the motor is low and the input current to the motor is high, thus, the voltage drop across the resistor R7 is high. As the rotation speed of the motor increases, the voltage drop across the resistor R7 decreases. The potential at the junction of the resistor R7 and the motor 53 is applied to the base of the transistor Q5 through the variable resistor VR1.

Upon switching ON of the switch S4, the motor 53 starts. Because of the slow ration of the motor 53 at the initial stage, the voltage drop across the resistor R7 is large, and the transistor Q5 is non-conductive. Therefore, the resistance in the base circuit of the transistor Q3 is essentially equal to the resistance of R4, and the astable multi-vibrator oscillates with the initial long oscillation period (for instance several seconds). Therefore, the period of the switching ON and OFF of the switch S3 in the base circuit of the transistor Q1 in the oscillator 91 is also several seconds. Therefore, the period of the smoke in the chimney 78 is also long, relating to the slow rotation of the driving wheels. It is assumed that the duty ratio of the astable multi-vibrator 92 is 50%, and therefore, the oscillator 91 is excited with the duty ratio 50%.

When the rotation speed of the driving wheels increases, and voltage drop across the resistor R7 decreases, and the transistor Q5 becomes conductive so that the essential resistance between the collector and the emitter of the transistor Q5 decreases. Therefore, the resistance in the base circuit of the transistor Q3 decreases as compared with the resistance of R4, the oscillation period of the astable multi-vibrator 92 decreases. Therefore, the switch S3 is switched ON and OFF with short period, and the period of generating smoke is also short corresponding to the increase of the speed of the steam locomotive.

Figure 15:
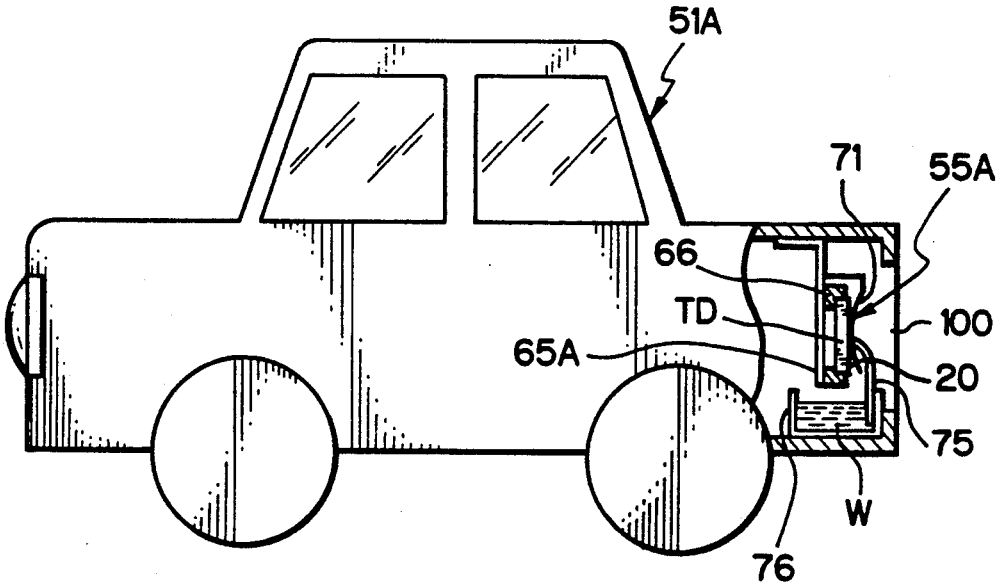
FIG. 15 shows structure of another toy which is an application of the present invention.

FIG. 15 shows another embodiment of a toy which has the present nebulizer for providing pseudo smoke. This embodiment concerns a toy of an automobile, in which the numeral 51A is a casing, 55A is a vibrator for providing mist. The vibrator 55A is fixed vertically, while the vibrator in FIG. 11 is fixed horizontally. The vibrator 55A is fixed to the support 65A through the resilient ring shaped holder 66. The operation surface of the vibrator 65A for providing mist faces with an exhaust pipe 100 at rear portion of an automobile. The structure of the vibrator 55A is essentially the same as that of FIG. 2 or FIG. 12.

The automobile of FIG. 15 operates as if it exhausts smoke as exhaust gas by releasing mist through the opening 100.

It should be noted of course that the application of the present nebulizer to a toy is not restricted to a steam locomotive and an automobile, but a monster, and any other toy is possible. An astable multi-vibrator in FIG. 14 may be substituted with a voltage controlled oscillator which is implemented by an IC.

As described above in detail, the present invention provides a nebulizer which provides mist operating with small power consumption. As the power is supplied intermittently, the instantaneous power to a vibrator is high in spite of low average power, and therefore, the temperature of a vibrator does not increase to high level, and therefore, the present invention may be used in a medical inhaler which supplies a patient sprayed mist of medicine which might be dissolved at high temperature.

Further, the present nebulizer has an application for generating pseudo smoke in a toy.

From the foregoing it will now be apparent that a new and improved nebulizer or an atomizer has been discovered. It should be understood of course that the embodiments disclosed are merely illustrative and are not intended to limit the scope of the invention. Reference should be made to the appended claims, therefore, rather than the specification as indicating the scope of the invention.

What is claimed is:

1. An ultrasonic wave nebulizer comprising;

a piezoelectric vibrator having a pair of electrodes on respective surfaces of the vibrator and defining an operation surface on one of the surfaces, a holder for holding said vibrator, a thin plate member having a plurality of small holes having at least a portion located close to said operation surface so that an essential gap space is provided between said portion of the plate member and the operation surface of the vibrator and thin liquid film is provided in said gap space through capillarity, supply means for supplying liquid to said gap space, a high frequency generator for exciting said vibrator, connecting means for connecting said generator to said electrodes of the vibrator, said vibrator vibrating in the thickness direction of the vibrator upon being excited with high frequency power between said electrodes to convert said thin liquid film to mist, WHEREIN THE IMPROVEMENT COMPRISES:

said high frequency generator exciting said vibrator intermittently with a predetermined duty ratio.

2. An ultrasonic wave nebulizer according to claim 1, wherein said nebulizer is mounted in a toy automobile for generating pseudo smoke by mist generated by said nebulizer, said pseudo smoke appearing as exhaust gas.

3. An ultrasonic wave nebulizer according to claim 1, wherein said duty ratio is less than 70%.

4. An ultrasonic wave nebulizer according to claim 3, wherein said duty ratio is in the range between 10% and 70%.

5. An ultrasonic wave nebulizer according to claim 1, wherein the thickness of said plate member is less than 200 μm, and the diameter of a hole of said plate member is less than 100 μm.

6. An ultrasonic wave nebulizer according to claim 1, wherein said supply means is a capillary action means.

7. An ultrasonic wave nebulizer according to claim 1, wherein a control means for adjusting intermittent frequency and duty ratio is provided.

8. An ultrasonic wave nebulizer according to claim 1, wherein said intermittent frequency is in range from 10 Hz to 20 KHz.

9. An ultrasonic wave nebulizer according to claim 1, wherein said piezoelectric vibrator is composed of a piezoelectric ceramics.

10. An ultrasonic wave nebulizer according to claim 1, wherein said nebulizer is mounted in a toy steam locomotive for generating pseudo smoke by mist generated by said nebulizer, said toy steam locomotive having a plurality of driving wheels excited by a motor, and wherein said vibrator is excited such that the period of excitation of the vibrator relates to motion of said driving wheels.

11. An ultrasonic wave nebulizer according to claim 10, wherein said steam locomotive has a whistle comprising a buzzer, which is energized in synchronism with the excitation of said nebulizer.

* * * * *